US005722002A

United States Patent [19]

Kikuta et al.

[11] Patent Number: 5,722,002

[45] Date of Patent: Feb. 24, 1998

[54] LATENT ELECTROSTATIC IMAGE DEVELOPING DEVICE HAVING A TONER CONCENTRATION DETECTOR

[75] Inventors: Shinji Kikuta; Tsutomu Nagata; Mitsuhiro Kashihara; Akihiko Ichiba; Kazuhito Takaoka; Hiroshi Kubota, all of Osaka, Japan

[73] Assignee: Mita Industrial Co., Ltd., Osaka, Japan

[21] Appl. No.: 719,244

[22] Filed: Sep. 24, 1996

[30] Foreign Application Priority Data

Oct. 5, 1995 [JP] Japan ..... 7-258412

[51] Int. Cl.[6] ..... G03G 15/08

[52] U.S. Cl. ..... 399/30; 366/291; 399/256; 399/258

[58] Field of Search ..... 399/30, 58, 63, 399/64, 254, 258, 260, 119, 256, 62; 222/DIG. 1; 366/291, 297

[56] References Cited

U.S. PATENT DOCUMENTS

| | | | |
|---|---|---|---|
| 4,956,669 | 9/1990 | Nakamura | 399/62 X |
| 4,989,539 | 2/1991 | Ichikawa | 399/256 |
| 5,303,011 | 4/1994 | Noguchi et al. | 399/58 |
| 5,353,103 | 10/1994 | Okamoto et al. | 399/63 |
| 5,495,320 | 2/1996 | Araki et al. | 399/256 |
| 5,510,882 | 4/1996 | Kikuta et al. | 399/258 X |
| 5,519,316 | 5/1996 | Hagiwara et al. | 399/30 X |

FOREIGN PATENT DOCUMENTS

| | | |
|---|---|---|
| 5-346735 | 12/1993 | Japan . |
| 6-250524 | 9/1994 | Japan . |

*Primary Examiner*—Arthur T. Grimley
*Assistant Examiner*—Sophia S. Chen
*Attorney, Agent, or Firm*—Antonelli, Terry, Stout, Kraus, LLP

[57] ABSTRACT

A latent electrostatic image developing device. A developer agitating/conveying mechanism is disposed in a development housing and has an agitating/conveying member for conveying a developer, while agitating it, along a developer application. A toner concentration detector is disposed in the bottom wall of the development housing to oppose the agitating/conveying member. The upper surface and the side surface of a detector portion of the toner concentration detector are connected by an arcuate surface or a chamfered surface. The toner concentration detector is fitted into an opening formed in the bottom wall of the development housing, and the upper surface of the detector portion protrudes from the inner surface of the bottom wall of the development housing by an amount nearly corresponding to the radius of the arcuate surface or the height of the chamfer of the chamfered surface.

5 Claims, 6 Drawing Sheets

LATENT ELECTROSTATIC IMAGE DEVELOPING DEVICE HAVING A TONER CONCENTRATION DETECTOR

FIELD OF THE INVENTION

This invention relates to a latent electrostatic image developing device for use in developing a latent electrostatic image to a toner image in image forming apparatuses such as electrostatic copying machines and electrostatic printing machines.

DESCRIPTION OF THE PRIOR ART

As is well known, a latent electrostatic image developing device of the type using a developer comprising a toner and carrier particles is widely used to develop a latent electrostatic image in image forming apparatuses. This latent electrostatic image developing device has a development housing for accommodating a developer, a developer applicator means for applying the developer in the development housing to a latent electrostatic image, a developer agitating/conveying device for agitating the developer in the development housing and conveying it in a desired direction, and a toner feed means for supplying a toner into the development housing. The developer applicator means usually includes a rotating sleeve member, on whose peripheral surface the developer is held to be conveyed to a developing zone. In the developing zone, toner in the developer is selectively adhered to a latent electrostatic image, whereby the latent image is developed to a toner image. When the toner in the developer has been consumed in accordance with the development of the latent electrostatic image, more toner is supplied by the toner feed means into the development housing. The developer agitating/conveying device agitates the developer within the development housing to mix and frictionally charge the toner and the carrier particles, and conveys the developer in a desired direction.

In the above-mentioned type of latent electrostatic image developing device, it is important that the developer be agitated sufficiently satisfactorily before being held on the developer applicator means and conveyed to the developing zone, and it is important that the developer, having the proportions of toner and the carrier particles within a desired range and having both components sufficiently uniformly mixed, be applied to the latent electrostatic image. It is also important that downstream of the developing zone, the developer, having the proportion of toner reduced as a result of adhesion of toner to the latent electrostatic image, be effectively released from the developer applicator means so as to be agitated and conveyed again within the development housing. To fulfill such requirements for agitating and conveying the developer, Japanese Utility Model Publication No. 27333/1975 and Japanese Laid-Open Patent Publication No. 260678/1991 disclose a developer agitating/conveying device composed of a first agitating/conveying member extending adjacent to a developer applicator means, and a second agitating/conveying member disposed upstream of the first agitating/conveying member. The first agitating/conveying member comprises a rotating shaft extending in a widthwise direction, and a pair of helical blades formed at spaced apart locations in the axial direction on the rotating shaft and helically wound about the rotating shaft in opposite directions to each other. The second agitating/conveying member also comprises a rotating shaft extending in the widthwise direction, and a pair of helical blades formed at spaced apart locations in the axial direction on the rotating shaft and helically wound about the rotating shaft in opposite directions to each other. The first agitating/conveying member is rotated in a predetermined direction, conveys the developer from the opposite end portions in the axial direction toward the central portion in the axial direction while agitating it, and transfers the developer to the central portion in the axial direction of the second agitating/conveying member. The second agitating/conveying member rotated similarly in a predetermined direction conveys the developer from the central portion in the axial direction toward the opposite end portions in the axial direction while agitating it, and transfers the developer at the opposite end portions in the axial direction to the first agitating/conveying member. The developer conveyed by the second agitating/conveying member from the central portion in the axial direction toward the opposite end portions in the axial direction is held by the developer applicator means for conveyance to the developing zone.

Japanese Laid-Open Patent Publication No. 260678/1991 further discloses that an inclined elliptic plate is disposed between the pair of helical blades on the rotating shaft of the second agitating/conveying member to distribute the developer, conveyed from one of the end portions to the central portion of the first agitating/conveying member, to both sides of the second agitating/conveying member, as well as to distribute the developer, conveyed from the other end portion to the central portion of the first agitating/conveying member, to both sides of the second agitating/conveying member, thereby ensuring the flow of the developer between one of the sides in the widthwise direction and the other side in the widthwise direction, and making the developer uniform throughout the widthwise direction.

As the toner is consumed under the developing action, the proportion of the toner and the carrier particles, so-called toner concentration, gradually lowers. When the toner concentration has become lower than a predetermined value, the toner feed means feeds more toner into the development housing. Thus, the developing device has a toner concentration detector for detecting the toner concentration of the developer within the development housing. The toner concentration detector is generally disposed on a so-called tip cutting plate for restricting the developer, which is held on and conveyed by the peripheral surface of a sleeve member constituting the developer applicator means, to a predetermined amount. However, the developer moving on the tip cutting plate varies in flow characteristics according to humidity. As a result, the output value of the toner concentration detector fluctuates. The placement of the toner concentration detector on the tip cutting plate is thus not entirely satisfactory for detecting the toner concentration accurately.

In the aforementioned developing device with a developer agitating/conveying mechanism, if the toner concentration detector is disposed to oppose an agitating/conveying member constituting the developer agitating/conveying mechanism, the developer is conveyed by the agitating/conveying member. Thus, the flow characteristics of the developer are not markedly influenced by humidity. The disposition of the toner concentration detector on the bottom wall of the development housing so as to oppose the agitating/conveying member, however, has been found to pose the following problem: As shown in FIG. 7, a toner concentration detector 3 is fitted into an opening la formed in a bottom wall 1 of the development housing to make an upper surface 3*b*, of a detector portion 3*a*, coplanar with the inner surface of the bottom wall 1. Since the upper surface 3*b* and a side surface 3*c* of the detector portion 3*a* are connected together by an arcuate surface 3*d*, a gap 5 of a wedge-shaped cross section is formed between the inner peripheral surface of the opening 1*a* formed in the bottom wall 1 of the development housing and the arcuate surface 3*d* of the detector portion 3*a*. If the developer enters the gap 5, the developer that has entered there stagnates and does not flow. The toner concentration value of this stagnant developer exerts an influence, making it difficult to detect the accurate toner concentration of the developer conveyed by the agitating/conveying member. Alternatively, the detector portion 3*a* of the toner concentration detector 3 is caused to protrude considerably from the inner surface of the bottom wall 1 of the development housing so that no gap will be formed between the inner peripheral surface of the opening 1*a* formed in the bottom wall 1 of the development housing and the arcuate surface 3*d* constituting the detector portion 3*a*. In this case, the side surface 3*c* of the detector portion 3*a* protruding from the inner surface of the bottom wall 1 impedes the smooth flow of the developer conveyed by the agitating/conveying member, thereby making it difficult to detect the accurate toner concentration of the developer conveyed by the agitating/conveying member. These results have been obtained in our experiments.

SUMMARY OF THE INVENTION

This invention has been accomplished in the light of the above findings. Its object is to provide a latent electrostatic image developing device which can accurately detect the toner concentration of a developer conveyed by an agitating/conveying member of a developer agitating/conveying mechanism without undergoing considerable influence from changes in humidity.

To attain this object, the present invention provides a latent electrostatic image developing device comprising:

a development housing for accommodating a developer;

a toner feed means for supplying a toner into the development housing;

a developer applicator means for applying the developer in the development housing to a latent electrostatic image;

a developer agitating/conveying mechanism disposed in the development housing and having an agitating/conveying member for conveying the developer, while agitating it, along the developer applicator means; and a toner concentration detector disposed in the bottom wall of the development housing in opposition to the agitating/conveying member, the upper surface and the side surface of a detector portion of the toner concentration detector being connected by an arcuate surface or a chamfered surface; wherein the toner concentration detector is fitted into an opening formed in the bottom wall of the development housing, and the upper surface of the detector portion protrudes from the inner surface of the bottom wall of the development housing by an amount nearly corresponding to the radius of the arcuate surface or the height of the chamfer of the chamfered surface.

The present invention also provides the latent electrostatic image developing device in which the developer agitating/conveying mechanism includes:

at least one partition wall disposed within the development housing and having a developer transfer port at the central portion thereof;

a first agitating/conveying member disposed along the partition wall on one side of the partition wall to convey the developer from the opposite end portions toward the central portion thereof, the first agitating/conveying member having a first helical blade and a second helical blade helically wound in opposite directions to each other; and a second agitating/conveying member disposed along the partition wall on the other side of the partition wall to convey the developer from the central portion toward the opposite end portions thereof, the second agitating/conveying member having a first helical blade and a second helical blade helically wound in opposite directions to each other; and the toner concentration detector is disposed in the bottom wall of the development housing in opposition to the first agitating/conveying member or the second agitating/conveying member.

The present invention further provides the latent electrostatic image developing device in which either the first agitating/conveying member or the second agitating/conveying member is provided with a distributing blade at a site between the first helical blade and the second helical blade, and the toner concentration detector is disposed in opposition to the distributing blade.

The present invention still further provides the latent electrostatic image developing device in which the developer agitating/conveying mechanism comprises:

an upstream-side partition wall and a downstream-side partition wall disposed parallel to and spaced from each other within the development housing, each partition wall having a developer transfer port at the central portion thereof;

a first agitating/conveying member disposed between the upstream-side partition wall and the downstream-side partition wall to convey the developer from the opposite end portions toward the central portion thereof, the first agitating/conveying member having a first helical blade and a second helical blade helically wound in opposite directions to each other;

a second agitating/conveying member disposed between the downstream-side partition wall and the developer applicator means along the downstream-side partition wall on the downstream side of the downstream-side partition wall to convey the developer from the central portion toward the opposite end portions thereof, the second agitating/conveying member having a first helical blade and a second helical blade helically wound in opposite directions to each other; and a third agitating/conveying member disposed along the upstream-side partition wall on the upstream side of the upstream-side partition wall to convey the developer from the central portion toward the opposite end portions thereof, the third agitating/conveying member having a first helical blade and a second helical blade helically wound in opposite directions to each other; and the toner concentration detector is disposed in opposition to the site between the first helical blade and the second helical blade of the first agitating/conveying member.

The present invention additionally provides the latent electrostatic image developing device in which a distributing blade is provided between the first helical blade and the second helical blade of the first agitating/conveying member, and the toner concentration detector is disposed in opposition to the distributing blade.

DETAILED DESCRIPTION OF THE PREFERRED EMBODIMENTS

The present invention will be described in more detail below with reference to the accompanying drawings illustrating preferred embodiments of the latent electrostatic image developing device constructed in accordance with the invention.

Figure 1:
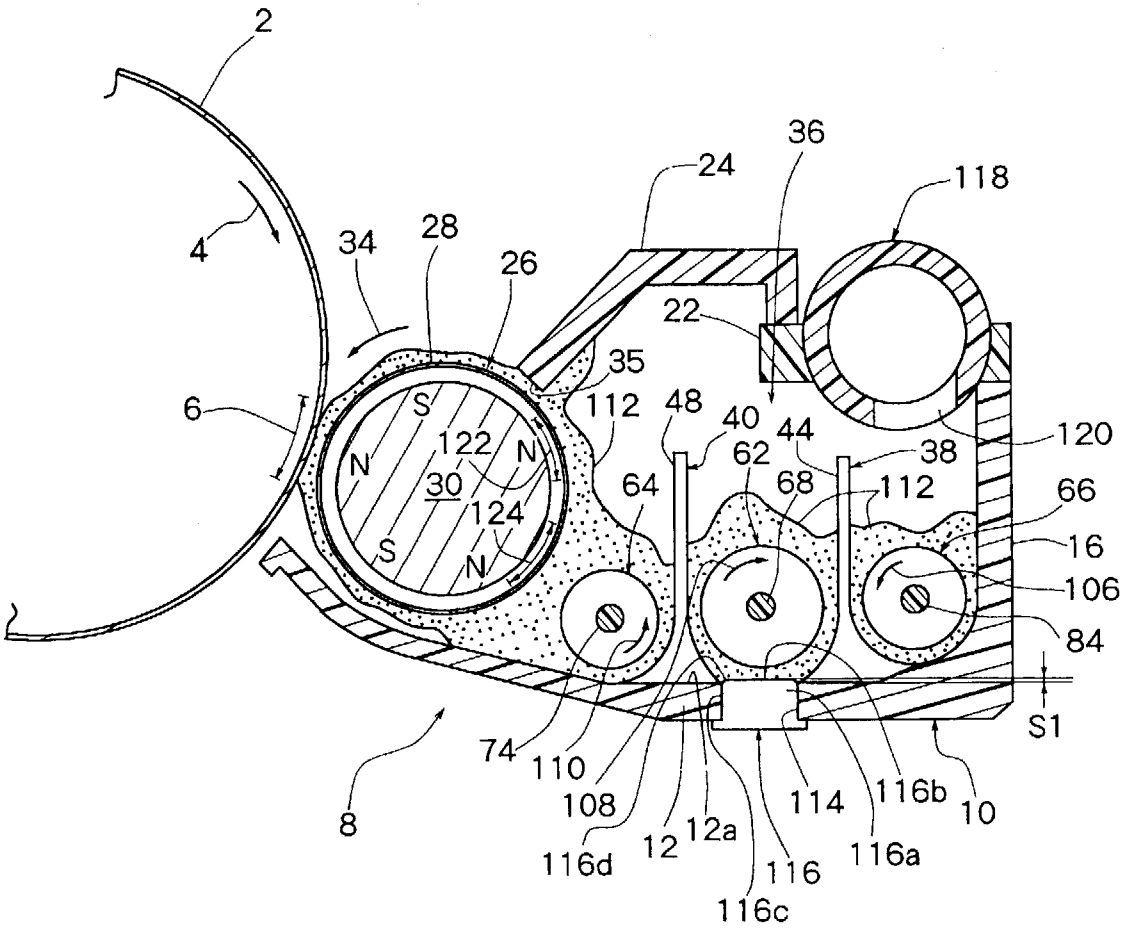
FIG. 1 is a sectional view showing an embodiment of a latent electrostatic image developing device constructed in accordance with the present invention.

FIG. 1 shows a latent electrostatic image developing device constructed in accordance with the present invention, along with part of a rotating drum of an electrostatic copying machine. A rotating drum 2, having a suitable electrostatic photosensitive material on its peripheral surface, is adapted to be rotated in the direction of an arrow 4, and passed through a developing zone 6. Upstream of the developing zone 6, a latent electrostatic image is formed on the peripheral surface of the rotating drum 2 by a suitable method well known per se. In the developing zone 6, a latent electrostatic image developing device, shown entirely at 8, constructed in accordance with the present invention develops the latent electrostatic image on the peripheral surface of the rotating drum 2 to a toner image. Downstream of the developing zone 6, the toner image is transferred to a transfer member such as paper, and fixed there, to obtain a copy or printed matter.

Figure 2:
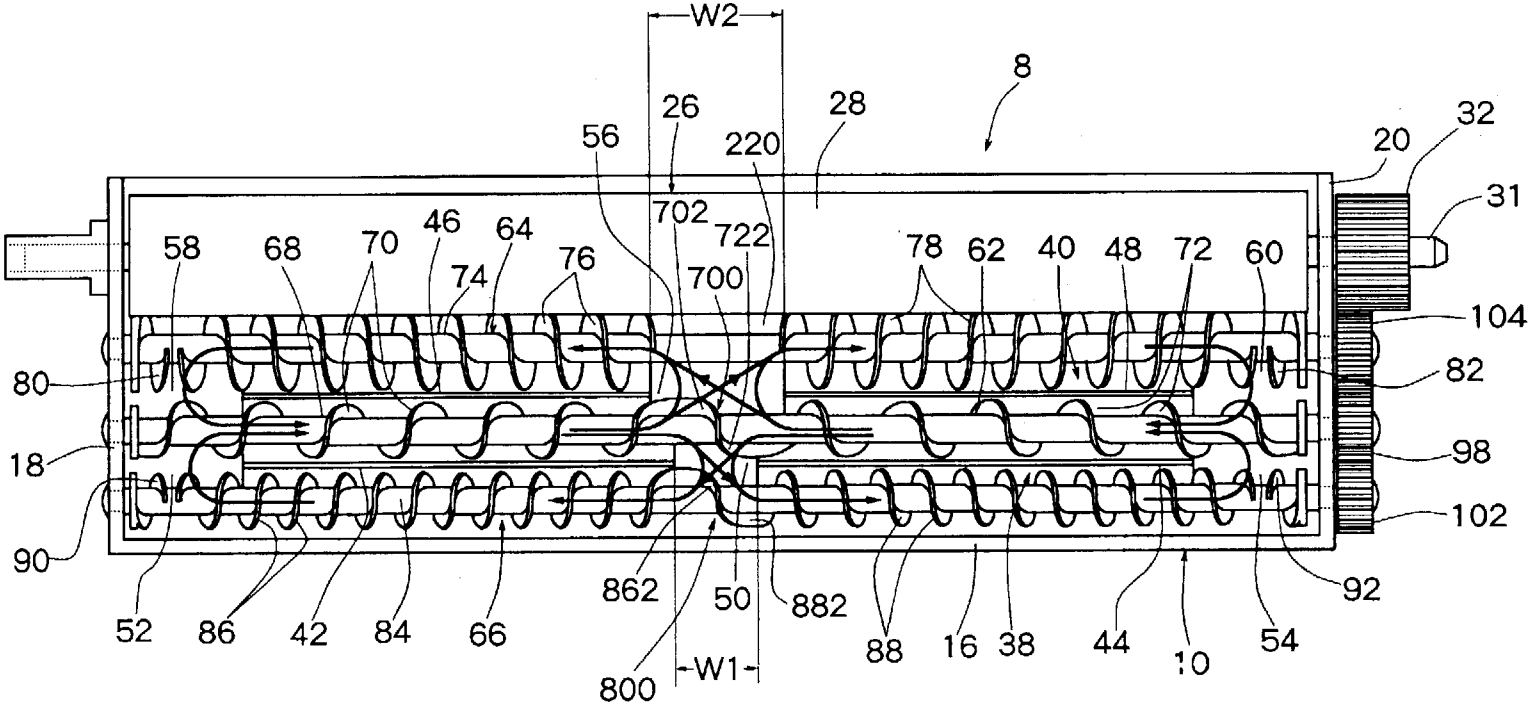
FIG. 2 is a plan view showing the latent electrostatic image developing device constructed in accordance with the present invention illustrated in FIG. 1, with the top wall of the development housing, the cover member, etc. being omitted.

With reference to FIGS. 1 and 2, the latent electrostatic image developing device 8 has a development housing 10. The development housing 10, which may be molded from a suitable synthetic resin, includes a bottom wall 12, a rear wall 16 extending substantially vertically upwards from the rear side edge of the bottom wall 12, a front end wall 18, and a rear end wall 20. To the rear wall 16 is connected a top wall 22 projecting substantially horizontally forwards from the upper end of the rear wall 16. To the top wall 22 is further connected a cover wall 24.

At a foremost portion of the development housing 10 (the leftmost portion in FIG. 1; the uppermost portion in FIG. 2) is disposed a developer applicator means 26. The developer applicator means 26 is constructed of a sleeve member 28 extending substantially horizontally in the widthwise direction, and a permanent magnet member 30 disposed within the sleeve member 28. The sleeve member 28 is formed of a non-magnetic material such as aluminum, and 15 mounted rotatably, while the permanent magnet member 30 is fixed at a predetermined position. As illustrated in FIG. 2, a rotating shaft 31 on which the sleeve member 28 is fixed protrudes rearwards through the rear end wall 20 of the development housing 10, and an input gear 32 is fixed to a protruding end portion of the shaft 31. The input gear 32 is drivingly connected to a rotary drive source (not shown), optionally an electric motor, via an input gear (not shown) of the rotating drum 2 so as to be rotationally driven in the direction of an arrow 34. A free end 35 of the cover wall 24 for the development housing 10 is located in proximity to the peripheral surface of the sleeve member 28 of the developer applicator means 26. As will be described in further detail later, the free end 35 functions as a so-called tip cutting means for controlling the amount of the developer conveyed to the developing zone 6 while being held on the peripheral surface of the sleeve member 28.

Behind the developer applicator means 26 is disposed a developer agitating/conveying device 36. In the illustrated embodiment, the developer agitating/conveying device 36 has an upstream-side partition wall 38 and a downstream-side partition wall 40 disposed parallel to each other with a predetermined spacing therebetween in the back-and-forth direction (the right-and-left direction in FIG. 1, and the up-and-down direction in FIG. 2) in the development housing 10. The upstream-side partition wall 38 is defined by upright walls 42 and 44 protruding substantially vertically upwards from the bottom wall 12 of the development housing 10. Likewise, the downstream-side partition wall 40 is defined by upright walls 46 and 48 protruding substantially vertically upwards from the bottom wall 12 of the development housing 10. As will be clearly understood from FIG. 1, both side surfaces of the lower end portion of each of the upright walls 42, 44, 46 and 48 are in a concave arcuate form. As will be clearly understood by reference to FIG. 2, none of the upright walls 42 and 44 is present at the central portion or the opposite end portions in the widthwise direction (the direction perpendicular to the sheet surface in FIG. 1, and the right-and-left direction in FIG. 2), but developer transfer ports 50 and 52, 54 are disposed at the central portion and the opposite end portions in the widthwise direction, respectively, of the upstream-side partition wall 38. Likewise, none of the upright walls 46 and 48 is present at the central portion or the opposite end portions in the widthwise direction, but developer transfer ports 56 and 58, 60 are disposed at the central portion and the opposite end portions in the widthwise direction, respectively, of the downstream-side partition wall 40. The dimension in the widthwise direction, W2, of the developer transfer port 56 provided at the central portion in the widthwise direction of the downstream-side partition wall 40 is set to be greater than the dimension in the widthwise direction, W1, of the developer transfer port 50 provided at the central portion in the widthwise direction of the upstream-side partition wall 38. The relationship between these dimensions in the widthwise direction, W2 and W1, is determined by various factors such as the size of the device and the copying speed. According to our experiments, the dimension in the widthwise direction, W2, is preferably 1.3 to 4.0 times, more preferably, 1.5 to 2.5 times as large as the dimension in the widthwise direction, W1. The widthwise dimensions of the developer transfer ports 52 and 54 disposed at the opposite end portions in the widthwise direction of the upstream-side partition wall 38, and the developer transfer ports 58 and 60 disposed at the opposite end portions in the widthwise direction of the downstream-side partition wall 40 may all be substantially the same, and preferably are each nearly equal to the dimension in the widthwise direction, W2, of the developer transfer port 56 provided at the central portion in the widthwise direction of the downstream-side partition wall 40.

The illustrated developer agitating/conveying device 36 includes a first agitating/conveying member 62 disposed between the upstream-side partition wall 38 and the downstream-side partition wall 40, a second agitating/conveying member 64 disposed along the downstream-side partition wall 40 on the downstream side of (i.e. ahead of) the downstream-side partition wall 40, and a third agitating/conveying member 66 disposed along the upstream-side partition wall 38 on the upstream side of (i.e. behind) the upstream-side partition wall 38. The first agitating/conveying member 62, the second agitating/conveying member 64, and the third agitating/conveying member 66 are disposed on the same plane in the illustrated embodiment.

The first agitating/conveying member 62 has a rotating shaft 68 mounted rotatably between opposite end walls 18 and 20 of the development housing 10. On the rotating shaft 68 are formed a pair of helical blades, namely a first helical blade 70 and a second helical blade 72, at spaced apart locations in the axial direction. The first helical blade 70 and the second helical blade 72 are constructed to have the same outside diameters, and are opposite to each other in terms of the direction of helical winding. As clearly shown in FIGS. 2 to 4, the first helical blade 70 and the second helical blade 72 are constructed such that their respective inner end half pitches 702, 722 overlap with a phase angle of 180 degrees relative to each other so as not to intersect each other. The first and second helical blades 70, 72 are connected by an overlap 700 formed by their inner end half pitches 702 and 722. The overlap 700 formed between the first helical blade 70 and the second helical blade 72 functions as a distributing blade for distributing the developer conveyed by the first helical blade 70 and the second helical blade 72. In the illustrated embodiment, the overlapping inner end half pitches 702, 722 of the first and second helical blades 70 and 72 are constructed to be great in the axial direction. The so constructed first developer agitating/conveying member 62 is rotated in the direction of an arrow 108 in FIG. 1, and conveys the developer from the opposite end portions toward the central portion while agitating it.

With reference to FIG. 2, the second agitating/conveying member 64 also has a rotating shaft 74 mounted rotatably between the opposite end walls 18 and 20 of the development housing 10. On the rotating shaft 74 are formed a pair of helical blades, namely a first helical blade 76 and a second helical blade 78, at spaced apart locations in the axial direction. The first helical blade 76 and the second helical blade 78 are constructed to have the same outside diameters, and are opposite to each other in terms of the direction of helical winding. The inner end of the first helical blade 76 and the inner end of the second helical blade 78 are each disposed at a predetermined distance from the center in the axial direction of the second agitating/conveying member 64. At the central portion in the axial direction of the second agitating/conveying member 64, therefore, a mixing portion 220 is formed between the inner end of the first helical blade 76 and the inner end of the second helical blade 78. At opposite end portions of the rotating shaft 74 are formed a first auxiliary helical blade 80 and a second auxiliary helical blade 82 positioned so as to face the first helical blade 76 and the second helical blade 78, respectively. The outside diameters of the first and second auxiliary helical blades 80 and 82 may be the same as the outside diameters of the first and second helical blades 76 and 78, respectively. The directions of helical winding of the first and second auxiliary helical blades 80 and 82 extending over the range with an angle of nearly 360 degrees are opposite to the directions of helical winding of the first and second helical blades 76 and 78 that the auxiliary helical blades 80 and 82 face. The so constructed second developer agitating/conveying member 64 is rotated in the direction of an arrow 110 in FIG. 1, and conveys the developer from the central portion toward the opposite end portions while agitating it.

With further reference to FIG. 2, the third agitating/conveying member 66 also has a rotating shaft 84 mounted rotatably between the opposite end walls 18 and 20 of the development housing 10. On the rotating shaft 84 are formed a pair of helical blades, namely a first helical blade 86 and a second helical blade 88, at spaced apart locations in the axial direction. The first helical blade 86 and the second helical blade 88 are constructed with the same outside diameters, and are helically wound in opposite directions to each other. Inner end half pitches 862, 882 of the first and second helical blades 86, 88, like the inner end half pitches 702, 772 of the first and second helical blades 70, 72 provided in the first agitating/conveying member 62 are connected by an overlap 800 so as to overlap with a phase angle of 180 degrees relative to each other without intersecting each other. Similar to the distributing blade 700 provided on the first agitating/conveying member 62, the overlap 800 functions as a distributing blade for distributing the developer conveyed by the first helical blade 86 and the second helical blade 88. The overlapping inner end half pitches 862, 882 of the first and second helical blades 86 and 88, respectively, are constructed to be great in the axial direction. The outer end in the axial direction of each of the first and second helical blades 86 and 88 is advantageously located in correspondence with nearly the middle in the widthwise direction of each of the developer transfer ports 52 and 54 disposed at the opposite end portions in the widthwise direction of the upstream-side partition wall 38. At opposite end portions of the rotating shaft 84 are formed a first auxiliary helical blade 90 and a second auxiliary helical blade 92 positioned so as to face the first helical blade 86 and the second helical blade 88, respectively. The outside diameters of the first and second auxiliary helical blades 90 and 92 may be the same as the outside diameters of the first and second helical blades 86 and 88, respectively. The directions of helical winding of the first and second auxiliary helical blades 90 and 92 extending over the range with an angle of nearly 360 degrees are opposite to the directions of helical winding of the first and second helical blades 86 and 88 that the auxiliary helical blades 90 and 92 face. The so constructed third developer agitating/conveying member 66 is rotated in the direction of an arrow 106 in FIG. 1, and conveys the developer from the central portion toward the opposite end portions while agitating it.

Figure 6:
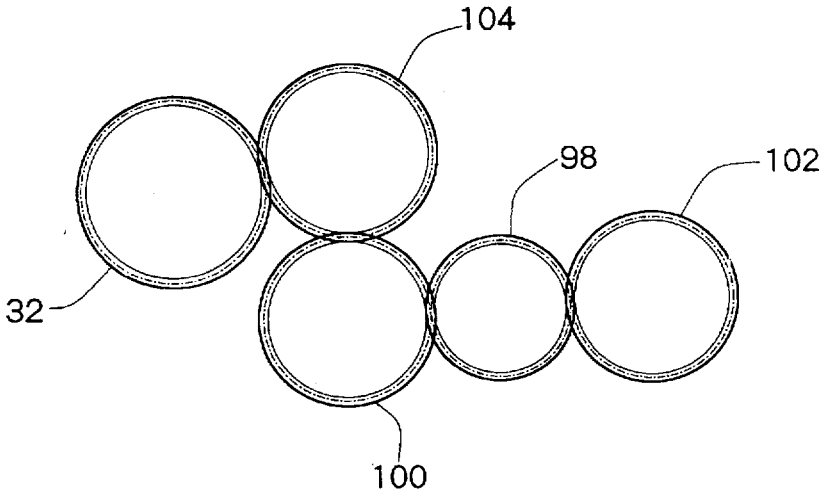
FIG. 6 is a schematic view showing the drivingly connected gears in the latent electrostatic image developing device illustrated in FIG. 1.
Figure 7:
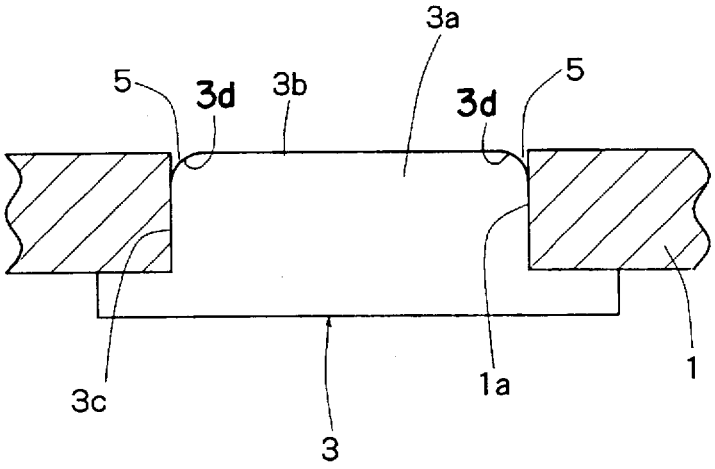
Fig. 7 (PRIOR ART)
FIG. 7 is a sectional view showing a conventional state of mounting of the toner concentration detector mounted on the latent electrostatic image developing device.

With reference to FIGS. 2 and 6, the rotating shaft 68 of the first agitating/conveying member 62, the rotating shaft 74 of the second agitating/conveying member 64, and the rotating shaft 84 of the third agitating/conveying member 66 are each caused to protrude rearwards through the rear end wall 20 of the development housing 10. At the rear end portions of the rotating shafts 68, 74 and 84 are fixed input gears 98, 100 and 102, respectively. The input gear 102 is engaged with the input gear 98, the input gear 98 is engaged with the input gear 100, and the input gear 100 is engaged with the input gear 32 of the developer applicator means 26 via a transmission gear 104 mounted rotatably on the rear end wall 20. Therefore, when the sleeve member 28 of the developer applicator means 26 is rotated by the rotary drive source (not shown) in the direction of arrow 34, the first agitating/conveying member 62 is rotated in the direction of arrow 108, the second agitating/conveying member 64 is rotated in the direction of arrow 110, and the third agitating/conveying member 66 is rotated in the direction of arrow 106, as shown in FIG. 1.

As illustrated in FIG. 1, a developer 112 comprising a toner and carrier particles is accommodated into the development housing 10. When housed there, the developer 112 is distributed suitably, i.e. on the side upstream of the upstream-side partition wall 38 (the right-hand side in FIG. 1, and the lower side in FIG. 2), between the upstream-side partition wall 38 and the downstream-side partition wall 40, and on the side downstream of the downstream-side partition wall 40 (the left-hand side in FIG. 1, and the upper side in FIG. 2). The third agitating/conveying member 66 being rotated in the direction of arrow 106 conveys the developer from the central portion in the axial direction toward the opposite end portions in the axial direction on the upstream side of the upstream-side partition wall 38 while agitating it. That is, the first helical blade 86 of the third agitating/conveying member 66 conveys the developer from the central portion in the axial direction toward one of the opposite end portions in the axial direction (the left end portion in FIG. 2) while agitating it, while the second helical blade 88 of the third agitating/conveying member 66 conveys the developer from the central portion in the axial direction toward the other end portion in the axial direction (the right end portion in FIG. 2) while agitating it. The first auxiliary helical blade 90 of the third agitating/conveying member 66 urges the developer inwards in the axial direction at one of the opposite end portions in the axial direction, while the second auxiliary helical blade 92 urges the developer inwards in the axial direction at the other end portion in the axial direction. The first agitating/conveying member 62 being rotated in the direction of arrow 108 conveys the developer from the opposite end portions in the axial direction toward the central portion in the axial direction between the upstream-side partition wall 38 and the downstream-side partition wall 40 while agitating it. That is, the first helical blade 70 of the first agitating/conveying member 62 conveys the developer from one of the end portions in the axial direction (the left end portion in FIG. 2) toward the central portion in the axial direction while agitating it, whereas the second helical blade 72 of the first agitating/conveying member 62 conveys the developer while agitating it. The second agitating/conveying member 64 being rotated in the direction of arrow 110 conveys the developer, while agitating it, from the central portion in the axial direction toward the opposite end portions in the axial direction on the downstream side of the downstream-side partition wall 40. That is, the first helical blade 76 of the second agitating/conveying member 64 conveys the developer from the central portion in the axial direction toward one of the end portions in the axial direction (the left end portion in FIG. 2) while agitating it, whereas the second helical blade 78 of the second agitating/conveying member 64 conveys the developer from the central portion in the axial direction toward the other end portion in the axial direction (the right end portion in FIG. 2) while agitating it. The first auxiliary helical blade 80 of the second agitating/conveying member 64 urges the developer inwards in the axial direction at one of the end portions in the axial direction, while the second auxiliary helical blade 82 urges the developer inwards in the axial direction at the other end portion in the axial direction.

It is important that the conveying capacity of the first agitating/conveying member 62 which conveys the developer from the opposite end portions in the axial direction to the central portion in the axial direction be set to be greater than the conveying capacity of each of the second agitating/conveying member 64 and the third agitating/conveying member 66, each conveying the developer from the central portion in the axial direction toward the opposite end portions in the axial direction. In order to bring the conveyance of the developer from the opposite end portions in the axial direction toward the central portion in the axial direction and the conveyance of the developer from the central portion in the axial direction toward the opposite end portions in the axial direction into substantial equilibrium, thereby rendering the developer present sufficiently uniformly throughout the axial direction, it is preferred that the conveying capacity of the first agitating/conveying member 62 be nearly consistent with the sum of the conveying capacities of the second agitating/conveying member 64 and that of the third agitating/conveying member 66. Preferably, the conveying capacity of the second agitating/conveying member 64 is set to be larger than the conveying capacity of the third agitating/conveying member 66. Advantageously, the conveying capacity of the second agitating/conveying member 64 is about 1.2 to 2.5 times as high as the conveying capacity of the third agitating/conveying member 66 (the reasons will be offered later on). The conveying capacity of each of the first, second, and third agitating/conveying members 62, 64 and 66 can be set as desired by suitably setting the rotational speed, pitch, and outside diameter of each of their first and second helical blades 70 and 72, 76 and 78, and 86 and 88, respectively. In the illustrated embodiments, the number of revolutions per unit time of the second agitating/conveying member 64 and the number of revolutions per unit time of the third agitating/conveying member 66 are the same, while the number of revolutions per unit time of the first agitating/conveying member 62 is set to be greater than any of these numbers of revolutions. The pitch of the first and second helical blades 76 and 78 of the second agitating/conveying member 64 is greater than the pitch of the first and second helical blades 86 and 88 of the third agitating/conveying member 66, while the pitch of the first and second helical blades 70 and 72 of the first agitating/conveying member 62 is even greater than that of the first and second helical blades 76 and 78 of the second agitating/conveying member 64. The outside diameter of the first and second helical blades 86 and 88 of the third agitating/conveying member 66 is the same as the outside diameter of the first and second helical blades 76 and 78 of the second agitating/conveying member 64, whereas the outside diameter of the first and second helical blades 70 and 72 of the first agitating/conveying member 62 is greater than the outside diameter of the helical blades 86, 88, 76 and 78.

Figure 3:
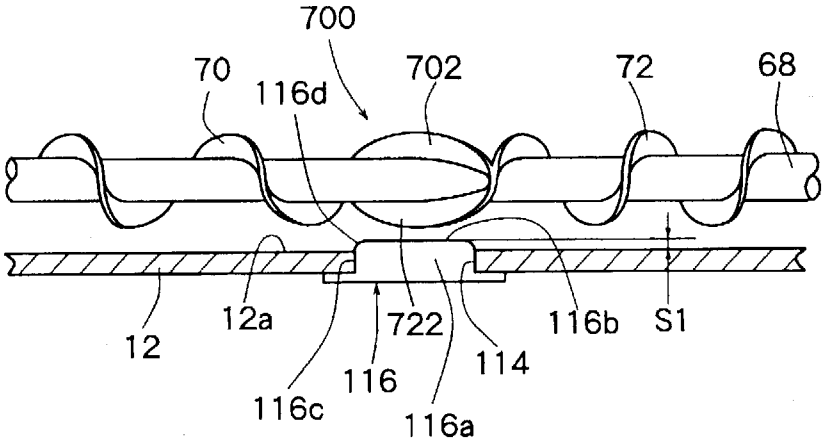
FIG. 3 is a fragmentary side view of the latent electrostatic image developing device illustrated in FIG. 1.

With reference to FIGS. 1 and 3, a rectangular opening 114 corresponding to the cross sectional shape of a detector portion 116*a* of a toner concentration detector 116 to be described later is formed at that widthwise central portion of the bottom wall 12 of the development housing 10 which lies between the upstream-side partition wall 38 and the downstream-side partition wall 40, namely, below the distributing blade 700 provided at a central portion of the first agitating/conveying member 62. This opening 114 is fitted with the detector portion 116*a* of the toner concentration detector 116 for detecting the toner concentration of the developer 112. The toner concentration detector 116 comprises a well known magnetic sensor. An upper surface 116*b* and a side surface 116*c* constituting the detector portion 116*a* of the toner concentration detector 116 are connected by an arcuate surface 116*d*. The radius constituting the arcuate surface 116*d* is set, in the illustrated embodiment, at 0.5 mm. The toner concentration detector 116 is disposed such that the upper surface 116*b* of the detector portion 116*a* protrudes from the inner surface 12*a* of the bottom wall 12 of the development housing 10. The amount S1 of this protrusion is set, in the illustrated embodiment, at 0.5 mm. Thus, the detector portion 116*a* of the toner concentration detector 116 fitted into the opening 114 formed in the bottom wall 12 of the development housing 10 makes no gap with respect to the inner surface of the opening 114, since the arcuate surface 116*d* protrudes from the inner surface 12*a* of the bottom wall 12. This makeup can prevent the trouble experienced with the conventional makeup that the developer penetrates a gap formed between the detector portion 116*a* of the toner concentration detector 116 and the inner surface of the opening 114, and this penetrating developer stagnates, thereby affecting the output value of the toner concentration detector 116. Furthermore, the protrusion of the detector portion 116*a* of the toner concentration detector 116 from the inner surface 12*a* of the bottom wall 12 is restricted to the arcuate surface 116*d* and the upper surface 116*b*, so that the developer conveyed by the first agitating/conveying member 62 flows smoothly without stagnating. In the illustrated embodiment, the toner concentration detector 116 is disposed to oppose the distributing blade 700 provided at the central portion of the first agitating/conveying member 62. Thus, under the scraper action of the distributing blade 700, the flow of the developer in the vicinity of the toner concentration detector 116 becomes even better, making the output value of the toner concentration detector 116 stabler. If the distance between the upper surface 116*b* of the detector portion 116*a* of the toner concentration detector 116 and the distributing blade 700 provided at the central portion of the first agitating/conveying member 62 is too small, the sensitivity of the toner concentration detector 116 is insufficient. If this distance is too large, replacement of the developer on the toner concentration detector 116 does not take place. Thus, the preferred distance is 1.5 to 3.0 mm. The toner concentration detector 116 constructed in this manner detects the toner concentration of the developer immediately before being moved to the second agitating/conveying member 64 after being agitated and conveyed by the first agitating/conveying member 62 from the opposite end portions toward the axially central portion. Then, the toner concentration detector 116 delivers this detection signal to controlling means (not shown).

Figure 5:
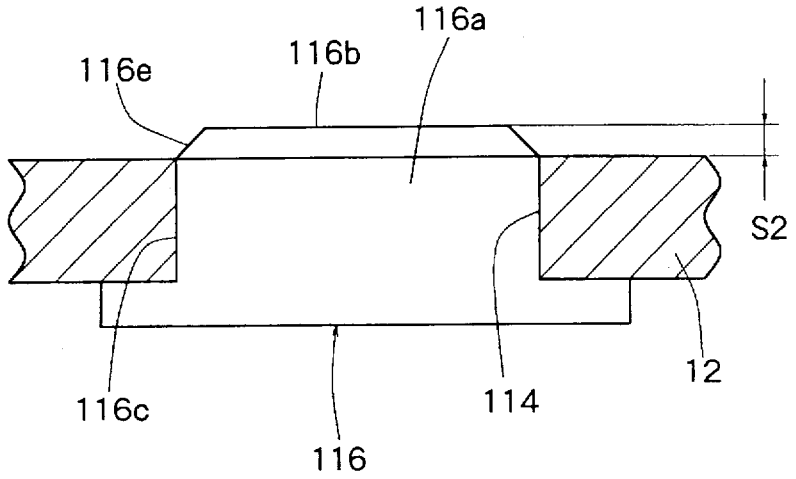
FIG. 5 is a sectional view showing another embodiment of the toner concentration detector mounted on the latent electrostatic image developing device, and the state of its mounting.

Next, another embodiment of the toner concentration detector 116 will be described based on FIG. 5. In the toner concentration detector 116 of this embodiment, an upper surface 116*b* and a side surface 116*c* constituting a detector portion 116*a* are connected together by a chamfered surface 116*e* chamfered at 45°. Other structure is substantially the same as in the above-described embodiment. Thus, the same parts are assigned the same numerals, and their explanation will be omitted. The so constructed toner concentration detector 116 has its detector portion 116*a* fitted into an opening 114 formed in the bottom wall 12 of the development housing 10. The amount of protrusion, S2, of the detector portion 116*a* of the toner concentration detector 116 from the inner surface 12*a* of the bottom wall 12 corresponds to the height of the chamfer, which is set at 0.5 mm in the instant embodiment. In this embodiment, the developer does not enter a gap which is otherwise formed between the detector portion 116*a* of the toner concentration detector 116 and the inner surface of the opening 114. Furthermore, the flow of the developer conveyed by the agitating/conveying member is not impeded. The latent electrostatic image developing device 8 is further provided with a toner feed means which is actuated depending on the toner concentration of the developer 112 to be detected by the detector 116. Such a toner feed means has a feeding pipe 118 disposed in the top wall 22 of the development housing 10. One end portion of the feeding pipe 118 is located above the central portion in the axial direction of the third agitating/conveying member 66, and a feed port 120 communicating with the inside of the development housing 10 is formed at the lowermost surface of the feeding pipe 118. The other end portion of the feeding pipe 118 which extends from the one end portion toward the front end in the widthwise direction is made to communicate with a toner receptacle (not shown), and a toner conveying means (not shown) constructible from a helical blade is disposed within the feeding pipe 118. When the toner concentration of the developer 112 detected by the detector 116 becomes less than a predetermined value, the toner conveying means in the feeding pipe 118 is actuated to convey the toner from the toner receptacle via the feeding pipe 118. Then, the toner is caused to fall through the feed port 120 onto the central portion of the third agitating/conveying member 66 within the development housing 10. When the toner concentration detected by the detector 116 becomes the predetermined value or more, the actuation of the toner conveying means within the feeding pipe 118 is ceased to terminate the toner supply to the development housing 10.

The actions and effects of the latent electrostatic image developing device 8 as described above are summarized as follows: The toner let fall through the feed port 120 formed in the feeding pipe 118 of the toner feed means is incorporated in the developer 112 within the development housing 10 after being evenly distributed on both sides from the central portion in the axial direction by the action of the overlap 800 between the inner end half pitches 862 and 882 of the first and second helical blades 86 and 88 of the third agitating/conveying member 66. The developer 112 present on the upstream side of the upstream-side partition wall 38 (the right-hand side in FIG. 1) is conveyed from the central portion in the axial direction toward the opposite end portions in the axial direction, while being agitated, by the action of the first and second helical blades 86 and 88 of the third agitating/conveying member 66. Since the conveying capacity of the third agitating/conveying member 66 is set to be relatively low, the developer 112 is conveyed at a relatively low speed from the central portion in the axial direction toward the opposite end portions in the axial direction by the third agitating/conveying member 66. During this motion, the developer 112 is fully agitated. The developer 112 conveyed to the opposite side portions in the axial direction by the third agitating/conveying member 66 is transferred forward through the developer transfer ports 52 and 54 disposed at the opposite side portions in the widthwise direction of the upstream-side partition wall 38, and introduced into the space between the upstream-side partition wall 38 and the downstream-side partition wall 40.

Figure 4:
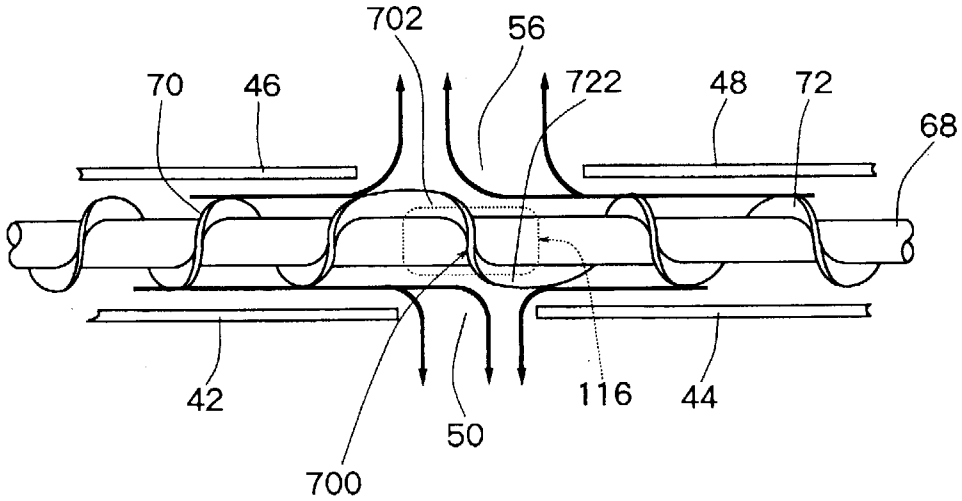
FIG. 4 is a fragmentary plan view showing the relationship between the first agitating/conveying member and the partition wall in the developer agitating/conveying mechanism mounted on the latent electrostatic image developing device illustrated in FIG. 1.

Then, in the space between the upstream-side partition wall 38 and the downstream-side partition wall 40, the developer 112 is conveyed, while being agitated, from the opposite side portions in the axial direction toward the central portion in the axial direction by the action of the first and second helical blades 70 and 72 of the first agitating/conveying member 62. The developer conveyed toward the central portion in the axial direction by the first helical blade 70 of the first agitating/conveying member 62, and the developer conveyed toward the central portion in the axial direction by the second helical blade 72 of the first agitating/ conveying member 62 flow at the central portion along the overlap 700 distributing blade constituted by the inner end half pitches 702 and 722 of the first and second helical blades 70 and 72, respective, as shown in FIG. 4. Thus, the developer conveyed by the first helical blade 70 and the developer conveyed by the second helical blade 72 are conveyed alternately beyond the center in the axial direction in accordance with the rotation of the overlap 700 distributing blade. Therefore, the developer conveyed from one region by the first helical blade 70, and the developer conveyed from the other region by the second helical blade 72 are mixed in nearly equal proportions, whereby the developer in the right region and that in the left region are uniformed. The developer thus mixed in nearly equal proportions from the right and left regions is transferred to the mixing portion 202 of the second agitating/conveying member 64 through the developer transfer port 56 provided at the central portion of the downstream-side partition wall 40. Part of this developer is transferred to the third agitating/conveying member 66 side through the developer transfer port 56 provided at the central portion of the upstream-side partition wall 38. Since the widthwise dimension W2 of the developer transfer port 56 formed in the downstream-side partition wall 40 is set to be relatively large, a relatively large amount of the developer 112 is advanced to the downstream side of the downstream-side partition wall 40 through the developer transfer port 56. On the other hand, since the widthwise dimension W1 of the developer transfer port 50 formed in the upstream-side partition wall 38 is set to be relatively small, the developer 112 returned to the upstream side of the upstream-side partition wall 38 through the developer transfer port 50 is in a relatively small amount. Moreover, the toner let fall through the toner feed port 120 can be reliably prevented from being directly introduced into the space between the upstream-side partition wall 38 and the downstream-side partition wall 40 through the developer transfer port 50 without being conveyed, while under agitation, by the third agitating/conveying member 66.

The developer transferred forward through the developer transfer port 56 disposed at the central portion in the widthwise direction of the downstream-side partition wall 40 is conveyed from the central portion in the axial direction to the opposite side portions in the axial direction, while being agitated, by the action of the first and second helical blades 76 and 78 of the second agitating/conveying member 64. The developer 112 conveyed to the opposite side portions in the axial direction is transferred rearward through the developer transfer ports 58 and 60 disposed at the opposite side portions in the widthwise direction of the downstream-side partition wall 40, returned to the space between the upstream-side partition wall 38 and the downstream-side partition wall 40, and then conveyed from the opposite side portions in the axial direction toward the central portion in the axial direction, while being agitated, by the action of the first and second helical blades 70 and 72 of the first agitating/conveying member 62.

Referring to FIGS. 1 and 2, on the downstream side of the second agitating/conveying member 64 (the left-hand side in FIG. 1, and the upper side in FIG. 2), the sleeve member 28 of the developer applicator means 26 is rotated in the direction shown by the arrow 34. In a developer draw-up zone indicated at 122 in FIG. 1, the developer 112 being conveyed from the central portion in the axial direction toward the opposite side portions in the axial direction, while being agitated, by the first and second helical blades 76 and 78 of the second agitating/conveying member 64 is partly drawn up to the peripheral surface of the sleeve member 28 owing to a magnetic field formed by the stationary permanent magnet member 30. The developer 112 drawn up to the peripheral surface of the sleeve member 28 is conveyed in the direction of arrow 34 attendant on the rotation of the sleeve member 28 for transportation to the developing zone 6. During this motion, an excess of the developer 112 is removed from the peripheral surface of the sleeve member 28 by the action of the free end 35 of the cover wall 24 of the development housing 10. In the developing zone 6, as stated previously, the toner in the developer 112 is selectively attached to a latent electrostatic image formed on the peripheral surface of the rotating drum 4 to develop the latent electrostatic image to a toner image. In a developer peeling zone 124 located downstream of the developing zone 6, the developer 112 is released from the peripheral surface of the sleeve member 28 owing to the reduction of the magnetic field formed by the permanent magnet member 30 or for any other reason. Such developer 112 is decreased in toner concentration because of the consumption of the toner in the developing zone 6. The developer 112 released from the peripheral surface of the sleeve member 28 is incorporated in the developer 112 within the development housing 10, and conveyed toward the opposite side portions in the axial direction, while being agitated, by the first and second helical blades 76 and 78 of the second agitating/conveying member 64. Since the conveying capacity of the second agitating/conveying member 64 is set to be greater than the conveying capacity of the third agitating/conveying member 66, the developer 112 is fully satisfactorily released from the peripheral surface of the sleeve member 28 in the developer peeling zone 124, and such developer 112 is incorporated and agitated fully rapidly into the developer 112 accommodated in the development housing 10.

During the aforementioned developing action, the toner concentration detector 116 detects the toner concentration of the developer that is a mixture of the developer conveyed to the axially central portion by the first helical blade 70 of the first agitating/conveying member 62 and the developer conveyed to the axially central portion by the second helical blade 72 of the first agitating/conveying member 62, the developers in the mixture being mixed in nearly equal proportions by the distributing blade 700. A toner concentration signal from the toner concentration detector 116 is sent to controlling means (not shown). When this toner concentration becomes less than a predetermined value, the controlling means actuates toner conveying means (not shown) in the feeding pipe 118. The toner is conveyed from the toner receptacle through the feeding pipe 118, and falls through the feed port 120 onto the central portion of the third agitating/conveying member 66 within the development housing 10. When the toner concentration detected by the toner concentration detector 116 reaches the predetermined value or more, the controlling means (not shown) ceases the action of the toner conveying means within the feeding pipe 118 to terminate toner supply to the development housing 10.

The present invention has been described based on the illustrated embodiments. However, the invention is not limited to these embodiments, and various changes and modifications may be made within the scope of the technical ideas of the invention. For example, the use of three agitating/conveying members has been indicated in the embodiments, but one, two or even more agitating/conveying members may be used. Furthermore, the distributing blade 700 provided between the first helical blade 70 and the second helical blade 72 of the first agitating/ conveying member 62 may be an inclined elliptical plate as disclosed in Japanese Laid-Open Patent Publication No. 260678/91.

The latent electrostatic image developing device of the present invention is constructed in the foregoing fashion, and the toner concentration detector is disposed to oppose the agitating/conveying member of the developer agitating/conveying mechanism. Thus, the developer conveyed by the agitating/conveying member flows, so that influence from varying flow characteristics of the developer because of changing humidity can be avoided. Moreover, the toner concentration detector, in which the upper surface and the side surface of the detector portion are connected by the arcuate surface or the chamfered surface, is fitted into the opening formed in the bottom wall of the development housing. The upper surface of the detector portion protrudes from the inner surface of the bottom wall of the development housing by a dimension nearly corresponding to the radius of the arcuate surface or the height of the chamfer. Thus, no gap is formed between the detector portion of the toner concentration detector and the inner surface of the opening. This can prevent the trouble that the developer penetrates a gap formed between the detector portion and the inner surface of the opening, and this penetrating developer stagnates, thereby affecting the output value of the toner concentration detector. Furthermore, the protrusion of the detector portion of the toner concentration detector from the inner surface of the bottom wall of the development housing is restricted to the arcuate surface or the chamfered surface and the upper surface, so that the developer conveyed by the agitating/conveying member flows smoothly without stagnating.

According to the present invention, the developer agitating/conveying mechanism includes at least one partition wall disposed within the development housing and having a developer transfer port at the central portion thereof; a first agitating/conveying member disposed along the partition wall on one side of the partition wall and conveying the developer from the opposite end portions toward the central portion thereof, the first agitating/conveying member having a first helical blade and a second helical blade helically wound in opposite directions to each other; and a second agitating/conveying member disposed along the partition wall on the other side of the partition wall and conveying the developer from the central portion toward the opposite end portions thereof, the second agitating/conveying member having a first helical blade and a second helical blade helically wound in opposite directions to each other; the toner concentration detector being disposed in the bottom wall of the development housing in opposition to the first agitating/conveying member or the second agitating/conveying member. This latent electrostatic image developing device with the developer agitating/conveying mechanism having the two agitating/conveying members achieves the same actions and effects as the above-described invention.

According to the present invention, moreover, either the first agitating/conveying member or the second agitating/conveying member is provided with a distributing blade at a site between the first helical blade and the second helical blade, and the toner concentration detector is disposed in opposition to the distributing blade. The scraper action of the distributing blade makes the flow of the developer near the toner concentration detector even better, stabilizing the output value of the toner concentration detector further.

According to the present invention, furthermore, the developer agitating/conveying mechanism comprises a first agitating/conveying member for conveying the developer from the opposite end portions toward the central portion; a second agitating/conveying member disposed adjacent to the developer applicator means on the downstream side of the first agitating/conveying member and conveying the developer from the central portion toward the opposite end portions; and a third agitating/conveying member disposed on the upstream side of the first agitating/conveying member and conveying the developer from the central portion toward the opposite end portions; the toner concentration detector being disposed in opposition to the site between the first helical blade and the second helical blade of the first agitating/conveying member. Thus, the toner concentration detector detects the toner concentration of the developer immediately before being moved to the second agitating/conveying member, which conveys the developer to the developer applicator means, after being thoroughly agitated and mixed by the first and third agitating/conveying members. Hence, the toner concentration detector can accurately detect the toner concentration of the developer for use in development.

The distributing blade is provided between the first helical blade and the second helical blade of the first agitating/conveying member, and the toner concentration detector is disposed in opposition to the distributing blade. The scraper action of the distributing blade makes the flow of the developer near the toner concentration detector even better, stabilizing the output value of the toner concentration detector further.

What we claim is:

1. A latent electrostatic image developing device comprising:

a development housing for holding a developer;

toner feed means for supplying toner into said development housing;

developer applicator means for applying the developer in said development housing to a latent electrostatic image;

a developer agitating/conveying mechanism disposed in said development housing and having a first agitating/conveying member for conveying the developer, while agitating it, along said developer applicator means; and a toner concentration detector disposed in the bottom wall of said development housing in opposition to said first agitating/conveying member, the upper surface and the side surface of a detector portion of said toner concentration detector being connected by an arcuate surface or a chamfered surface; wherein said toner concentration detector is fitted into an opening formed in the bottom wall of said development housing, and the upper surface of said detector portion protrudes from the inner surface of the bottom wall of said development housing by an amount nearly corresponding to the radius of the arcuate surface or the height of the chamfer of said chamfered surface.

2. The latent electrostatic image developing device of claim 1, wherein:

said developer agitating/conveying mechanism includes at least one partition wall disposed within said development housing and having a developer transfer port at the central portion thereof;

said first agitating/conveying mechanism is disposed along said partition wall on one side of said partition wall to convey the developer from the opposite end portions toward the central portion thereof, said first agitating/conveying member having a first helical blade and a second helical blade helically wound thereon in opposite helical directions to each other;

said developer agitating/conveying member further includes a second agitating/conveying member disposed along said partition wall on the other side of said partition wall to convey the developer from the central portion toward the opposite end portions thereof, said second agitating/conveying member having a third helical blade and a fourth helical blade helically wound thereon in opposite helical directions to each other; and said toner concentration detector is disposed in the bottom wall of said development housing in opposition to said first agitating/conveying member or said second agitating/conveying member.

3. The latent electrostatic image developing device of claim 2, wherein one of said first agitating/conveying member and said second agitating/conveying member is provided with a distributing blade at a site between the helical blades thereof, and said toner concentration detector is disposed in opposition to said distributing blade.

4. The latent electrostatic image developing device of claim 1, wherein:

said developer agitating/conveying mechanism includes an upstream-side partition wall and a downstream-side partition wall disposed parallel to and spaced from each other in said development housing, each partition wall having a developer transfer port at the central portion thereof;

said first agitating/conveying member is disposed between said upstream-side partition and said downstream-side partition wall to convey the developer from the opposite end portions toward the central portion thereof, said first agitating/conveying member having a first helical blade and a second helical blade helically wound thereon in opposite helical directions to each other;

said developer agitating/conveying mechanism further includes a second agitating/conveying member disposed adjacent to said developer applicator means along said downstream-side partition wall on the downstream side of said downstream-side partition wall to convey the developer from the central portion toward the opposite end portions thereof, said second agitating/conveying member having a third helical blade and a fourth helical blade helically wound thereon in opposite helical directions to each other; and a third agitating/conveying member disposed along said upstream-side partition wall on the upstream side of said upstream-side partition wall to convey the developer from the central portion toward the opposite end portions thereof, said third agitating/conveying member having a fifth helical blade and a sixth helical blade helically wound thereon in opposite helical directions to each other; and said toner concentration detector is disposed in opposition to the site between said first helical blade and said second helical blade of said first agitating/conveying member.

5. The latent electrostatic image developing device of claim 4, further comprising a distribution blade between said first helical blade and said second helical blade of said first agitating/conveying member, and wherein said toner concentration detector is disposed in opposition to said distributing blade.

* * * * *